United States Patent [19]

Shagarova et al.

[11] Patent Number: 4,721,259

[45] Date of Patent: Jan. 26, 1988

[54] DISINTEGRATOR

[76] Inventors: Bella U. Shagarova; Olev G. Reemet, both of Mustamyae tee, 149, kv. 113; Aare P. Purga, bulvar Gagarina, 12, kv. 6, all of Tallin; Oleg N. Tikhonov, 17 linia 40, kv. 53, Leningrad, all of U.S.S.R.

[21] Appl. No.: 829,126

[22] PCT Filed: Jan. 17, 1985

[86] PCT No.: PCT/SU85/00003

§ 371 Date: Dec. 4, 1985

§ 102(e) Date: Dec. 4, 1985

[87] PCT Pub. No.: WO85/04822

PCT Pub. Date: Nov. 7, 1985

[30] Foreign Application Priority Data

Apr. 23, 1984 [SU] U.S.S.R. ..... 3736471

[51] Int. Cl.[4] ..... B02C 13/22

[52] U.S. Cl. ..... 241/57; 241/188 A

[58] Field of Search ..... 241/57, 55, 188 A, 188 R, 241/189 R

[56] References Cited

U.S. PATENT DOCUMENTS

| | | | |
|---|---|---|---|
| 2,039,264 | 4/1936 | Seckendorff | 241/188 A X |
| 3,894,695 | 7/1975 | Benedikter | 241/188 A X |
| 4,146,185 | 3/1979 | Schober | 241/188 R |
| 4,659,025 | 4/1987 | Tjumanok et al. | 241/188 R X |

FOREIGN PATENT DOCUMENTS

| | | | |
|---|---|---|---|
| 879803 | 4/1953 | Fed. Rep. of Germany | 241/188 A |
| 938236 | 6/1982 | U.S.S.R. . | |
| 982633 | 12/1982 | U.S.S.R. | 241/188 A |

OTHER PUBLICATIONS

I. A. Hint, "Fundamentals of Production of Silicon Calcium Articles", published in 1962, "Gosstroiizdat" publishers, Moscow-Leningrad, pp. 123-126.

Advertising Pamphlet of Alfred Herbert Ltd., Great Britain.

*Primary Examiner*—Timothy V. Eley

*Attorney, Agent, or Firm*—Burgess, Ryan & Wayne

[57] ABSTRACT

The disintegrator comprises the housing (1) having rotors mounted therein, with beaters (8) secured on the carrier members of the rotors and defining rows arranged one after another in the radial direction. At least one carrier member in at least one row of the beaters (8) has at least one opening or slot (11) made therethrough.

2 Claims, 7 Drawing Figures

DISINTEGRATOR

TECHNICAL FIELD

The invention relates to apparatus for breaking up, mixing and agitating various materials, and more particularly it relates to disintegrators.

PRIOR ART

At present, there are known disintegrators comprising a housing with a charging pipe and a discharge pipe, and rotors mounted inside the housing for rotation in opposite directions, having discs with beaters secured thereon and defining rows extending one after another in the radial direction (see I. A. Hint, "Fundamentals of Production of Silicon-Calcium Articles" published in 1962, "GOSSTROIIZDAT" Publishers, Moscow-Leningrad, pp. 123–126).

In this disintegrator the processed material is fed into the center of the rotating rows of beaters via the charging pipe. Upon contact with the beaters of the row closest to the centre of rotation, particles of the material are imparted the speed corresponding to this row and projected by the centrifugal forces from the path of this row toward the successive row of beaters, where they are broken up and propelled toward the next successive row of beaters, and so on, until they are ejected by the last-in-succession row of beaters. Thus, the entire volume of the material in the working zone of the rotors is put through the working cycle, including that part of the material which has been already disintegrated to the required fineness. Dwelling in the working zone in the suspended state, the finer part of the disintegrated final product is more susceptible to the motion of swirling streams of the gaseous or air medium in the rotors than to the action of the beaters, so that larger particles propelled through the suspended finer material lose some of their speed, and the impact of the beaters of the successive row thereupon becomes less effective. Furthermore, the processing of the material already disintegrated to the required fineness consumes some of the energy input, as its fine particles are engaged by beaters of successive rows.

There are also known disintegrators of the "attrition disintegrator" type, comprising a disc supporting thereon beaters of the first and second disintegration zones, and stationary beaters interposed between the rows of beaters of the second zone and secured to the housing of the attrition disintegrator, with the final product being exhausted from the second zone by suction in a stream of air, while particles not yet disintegrated to the required fineness of the final product are propelled by the centrifugal forces into the milling zone (cf. advertising pamphlet of Alfred Herbert Ltd., Great Britain).

This disintegrator is of a complicated structure, and its operation is associated with a high energy input on account of the final product being drawn by the air from the peripheral rows of beaters toward the centre, increasing the density of the medium in which the beaters are rotated, and also stepping up the energy input due to collisions of particles of the already disintegrated product with the beaters.

There is further known a disintegrator which is considered the closest prior art of the present invention, comprising a housing with a charging pipe and a discharge pipe. Mounted inside the housing for rotation in opposite directions are rotors with carrier members having beaters secured thereon by their end faces, defining rows extending one after another in the radial direction (cf. SU Inventor's Certificate No. 938,236; Int. Cl.[3] BO2C 13/22, published in 1982).

In this disintegrator the processed material passes through all the rows of beaters, and upon leaving the peripheral row enters the zone with a transverse stream of air, where finer particles of the final product are separated and carried toward the transport disc for the final product, belonging to the conveying arrangement. Coarser particles are returned into the charging pipe by the conveying arrangement for repeated milling.

Among shortcomings of this disintegrator are its complicated structure, an additional input of energy into the arrangements for conveying the coarse and fine products, inadequate effectiveness of their separation due to the material entering the zone of separation in a mixture with a high velocity, and an extra input of energy into conveying fine particles of the already disintegrated final product through all the beater rows.

ESSENCE OF THE INVENTION

The object of the present invention is to create a disintegrator wherein the improved structure of the rotor should provide for reducing the energy input and stepping up the efficiency of disintegration, while adequately separating the processed material.

The object of the present invention is attained in a disintegrator comprising a housing with a charging pipe and a discharge pipe, having mounted therein for rotation in opposite directions rotors with carrier members having beaters secured thereon by their end faces, defining rows arranged one after another in the radial direction, in which disintegrator, in accordance with the invention, at least one carrier member in at least one row of the beaters has made therethrough at least one opening or slot.

Owing to the presence of the openings in the carrier members, it becomes possible to remove the final product from a zone defined by two successive beaters, wherein separation has occurred under the action of the air or gas supplied for the processing of the material, which provides for a reduction of the energy input and a higher efficiency of disintegration, as it decreases the amount of the processed material directed toward the working surfaces of the beaters and their successive rows.

It is expedient to select the shape or profile of the opening or slot in correspondence with the dimensions of the rotor and the required parameters of the final product.

In operation of disintegrators of a high throughput, where considerable quantities of air or gas are required for conveying the final product from the rotor, it is expedient that the openings or slots in the carrier members disposed to one side of the symmetry axis of the rotors, should communicate with a system of forced feed of air, and that the openings or slots in the carrier members disposed to the other side of the symmetry axis of the rotors should communicate with the discharge system.

SUMMARY OF THE DRAWINGS

The invention will be further described in connection with embodiments thereof, with reference being made to the accompanying drawings, wherein.

PREFERRED EMBODIMENT OF THE INVENTION

Figure 1:
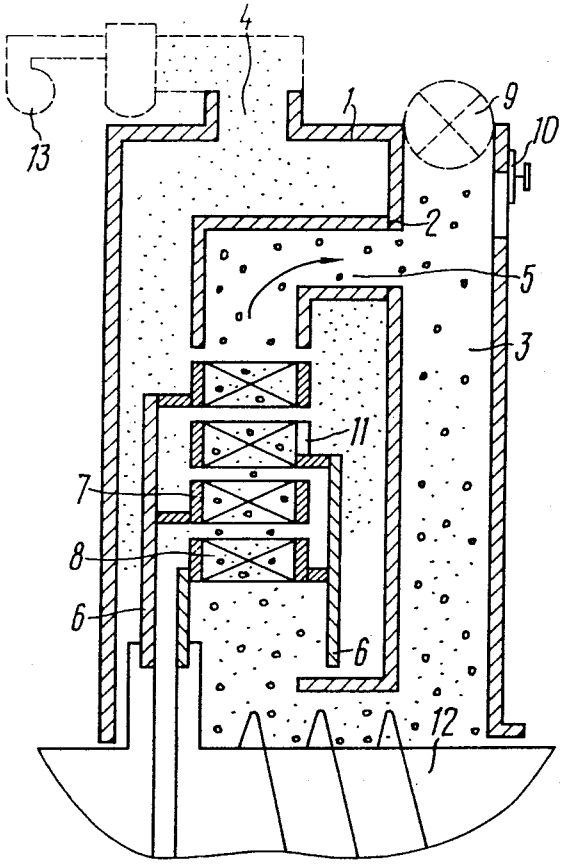
FIG. 1 is a longitudinal sectional view of a disintegrator embodying the invention.

The disintegrator includes a housing 1, a casing 2, a charging pipe 3 for the processed material, a discharge pipe 4 for the material, and a pipe 5 for the material directed toward the casing 2 (FIG. 1); and rotors comprising carrier members in the form of discs 6 and rings 7 to which beaters 8 are secured. Mounted on the charging pipe 3 is a feeder 9 adapted to cut off the input of air at the inlet, and a device 10 for controlling the quantity of air coming into the rotor. At least one of the carrier members, e.g. ring 7, as it is shown in FIG. 1, has an opening or slot 11 for withdrawing the air or gas jointly with the final product by suction from the row of the beaters. The disintegrator further includes a screw 12 for feeding the processed material into the rotors, and the discharge pipe 4 communicating with a fan 13.

Figure 2:
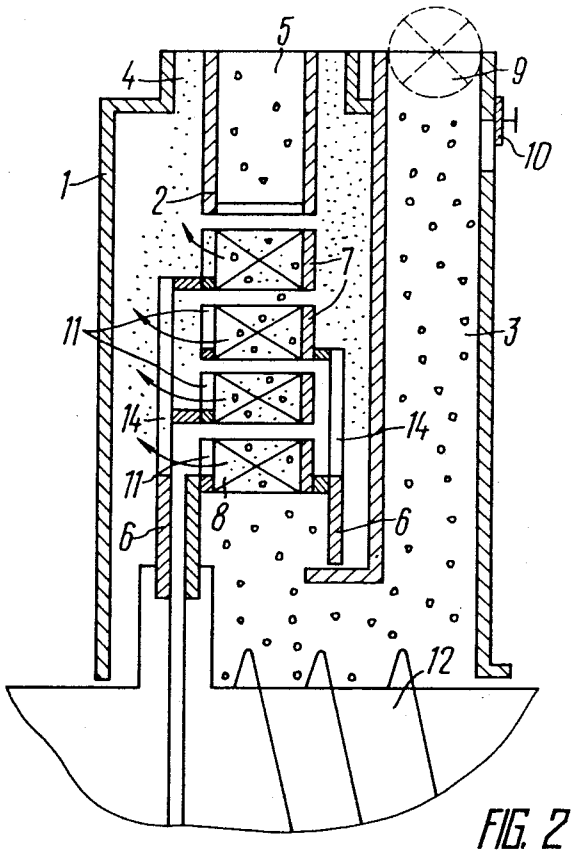
FIG. 2 is a longitudinal sectional view of a modified disintegrator embodying the invention.

The openings or slots 11 can be made in all the rows of the beaters 8, in the rings 7 disposed to one side of the axis of symmetry of the rotor, as it is shown in FIG. 2, and in this embodiment of the invention the discs 6 are preferably provided with spokes 14.

Figure 4:
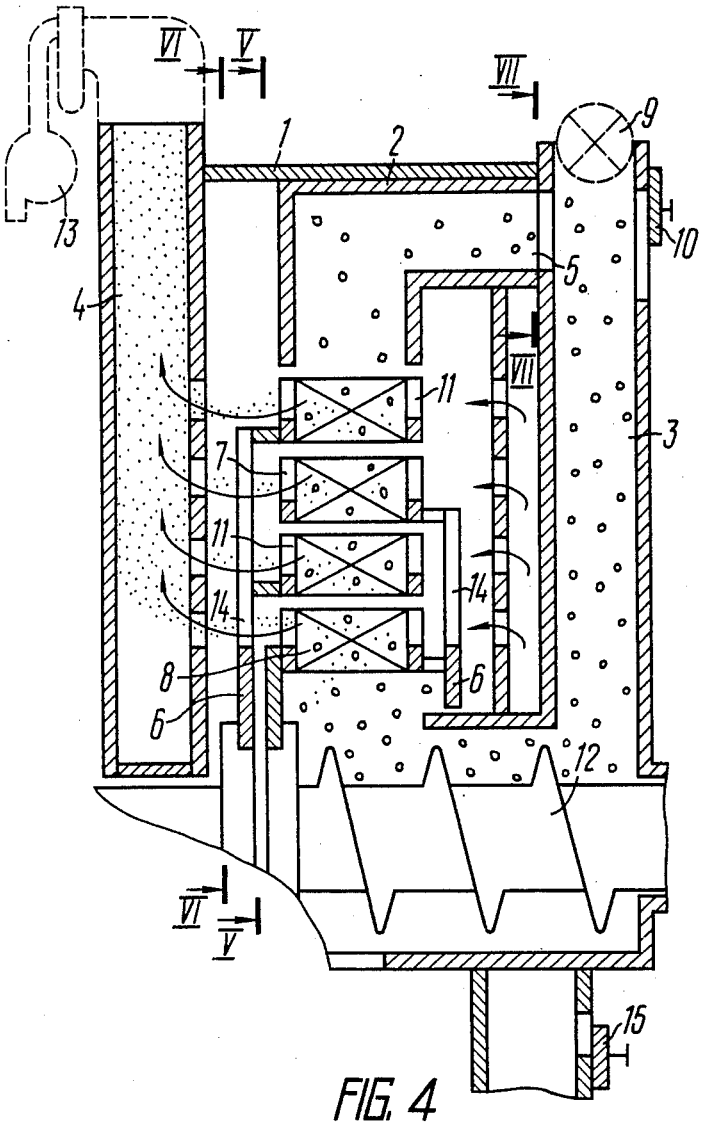
FIG. 4 is a longitudinal sectional view of a modified disintegrator embodying the invention, with a forced feed of air.

Alternatively, the openings or slots 11 in the rings 7 can be made in all the rows of the beaters to both sides of the axis of symmetry of the rotor, as it is shown in FIG. 4. This modification of the rotor yields the maximum effect of reducing the energy input and enhancing the fineness of disintegration. It is expedient that in disintegrators of higher throughputs the openings or slots made in the rings 7 disposed to one side of the symmetry axis of the rotor should communicate with a system 15 for forced feed of air, and the openings or slots 11 made in the rings 7 disposed to the other side of the symmetry axis of the rotor should communicate with the suction fan 13.

Figure 5:
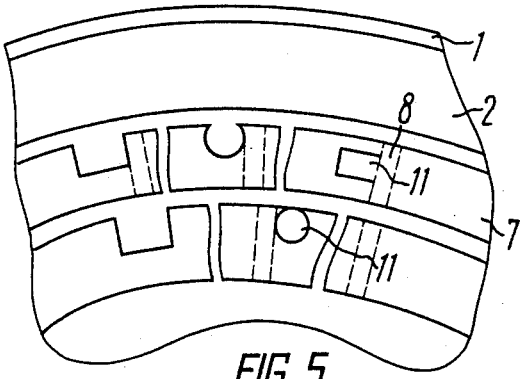
FIG. 5 is a sectional view taken on line V—V of FIG. 4.
Figure 6:
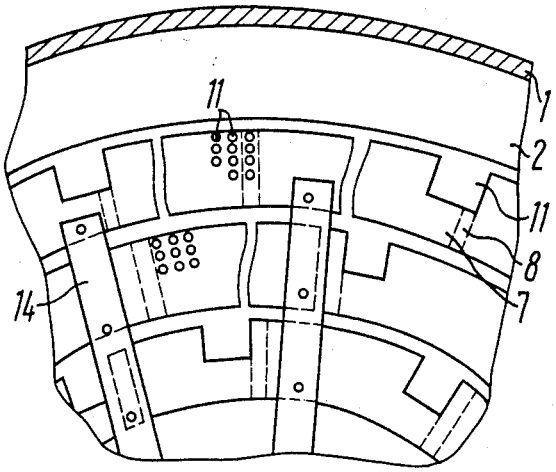
FIG. 6 is a sectional view taken on line VI—VI of FIG. 4.

The profile or shape of each opening or slot 11 is selected to correspond to the dimensions of the rotor and to the parameters of the final product, and it may have various configurations, as can be seen in FIGS. 5 and 6, and their number intermediate a pair of beaters may also be different, as shown in FIG. 6.

Figure 3:
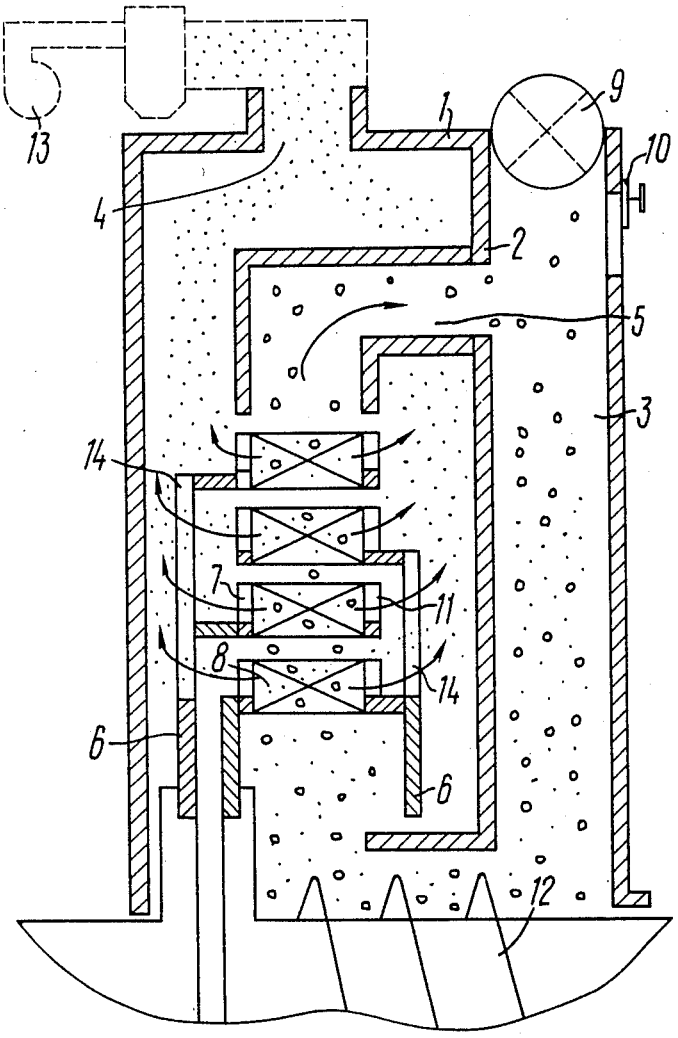
FIG. 3 is a longitudinal sectional view of another modification of a disintegrator embodying the invention.
Figure 7:
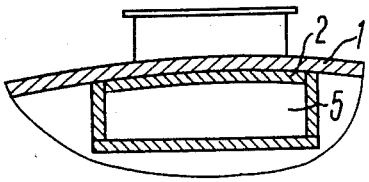
FIG. 7 is a sectional view taken on line VII—VII of FIG. 4.

FIG. 7 of the appended drawings illustrates a modification of the disclosed disintegrator where the pipe 5 for coarser product encompasses the entire perimeter of the casing 2. The disintegrator illustrated in FIG. 3 operates, as follows.

The material is fed through the feeder 9 into the charging pipe 3 jointly with air coming in from the device 10, to be propelled against the beaters 8 of the rotor by the rotating feed screw 12. The impact against the working surface of a beater 8 disintegrates particles of the material, and a fraction of the final product, i.e. of the product of the required fineness of particles, is produced. The centrifugal forces propel the disintegrated product toward the successive row of the beaters 8, where the action of the opposing stream of air upon the flight of the product toward the working surface of the beater 8 results in separation of the material. The openings or slots 11 are provided in the rings 7 intermediate the pair of successively arranged beaters 8 in the zone including the path of the particles of the final product, accounting for the action of the oncoming stream of air. Thus, the final product is withdrawn through the openings or slots 11 in the flow of air entering the rotor via the device 10 and sucked in, e.g. by the suction fan 13. The particles which are to be further disintegrated engage the beaters 8, to be broken up and directed toward the successive processing row. Upon disintegration in the peripheral processing row, the remaining product is directed against the casing 2 and returned into the charging pipe 3 through the discharge pipe 5 of the disintegrator, to undergo final disintegration jointly with the initial material being charged.

Owing to the withdrawal of the final product from the processing rows, the disclosed disintegrator provides for reducing the input of energy, and also for enhancing the efficiency of disintegration, due to the reduction of the specific load of the processed material per unit of area of the working surface of a beater in the successive rows of the beaters.

Furthermore, the employment of the oncoming stream of air in the rows of the beaters for advance separation of the particles of the material provides for a high efficiency of separation by the final product, and allows for classifying moist materials.

INDUSTRIAL APPLICABILITY

The invention can be utilized to utmost advantage in the industry of construction materials, in coal industry, in iron and steel industry, and in chemical industry.

We claim:

1. A disintegrator comprising:

a housing having a charging pipe;

a plurality of rotors mounted in said housing such that adjacent rotors are capable of being rotated in opposite directions;

carrier means secured to each said rotor in radially displaced rows;

beaters secured on said carrier means; and at least one of said carrier means in at least one row including at least one substantially radially directed side with at least one opening or slot.

2. A disintegrator according to claim 1, wherein openings or slots in the carrier means are axially offset on opposite sides of the respective rotor, openings or slots on one side of the rotor being in fluid communication with a forced air feed system, and openings or slots in the carrier means at the opposite side of the rotor being in fluid communication with a material and air discharge device.

* * * * *